US005950737A

United States Patent [19]

Chou et al.

[11] Patent Number: 5,950,737

[45] Date of Patent: Sep. 14, 1999

[54] DRILLING RISER CENTRALIZER

[75] Inventors: Yung-sen Chou, Houston; Jeffrey D. Otten, Cypress; Sammy R. Moore, The Woodlands, all of Tex.; Michael E. Capesius, Santa Paula, Calif.

[73] Assignee: ABB Vetco Gray Inc., Houston, Tex.

[21] Appl. No.: 08/889,271

[22] Filed: Jul. 8, 1997

[51] Int. Cl.[6] ..... E21B 7/128

[52] U.S. Cl. ..... 175/5; 166/355; 405/195.1

[58] Field of Search ..... 175/5; 166/355, 166/349, 352; 405/195.1

[56] References Cited

U.S. PATENT DOCUMENTS

| | | | |
|---|---|---|---|
| 3,145,775 | 8/1964 | McCarty | 166/352 |
| 3,456,745 | 7/1969 | Peri | 175/5 |
| 4,053,022 | 10/1977 | Mercier | 175/5 |
| 4,423,983 | 1/1984 | Dadiras et al. | 405/195.1 |
| 4,469,181 | 9/1984 | Kellett | 166/341 |
| 4,505,614 | 3/1985 | Anschutz | 405/195.1 |
| 4,616,708 | 10/1986 | Da Mota | 166/355 |
| 4,617,998 | 10/1986 | Langner | 166/355 |
| 4,733,991 | 3/1988 | Myers . | |
| 4,844,660 | 7/1989 | Ortemond | 405/224 |
| 5,158,397 | 10/1992 | Koos et al. | 405/195.1 |
| 5,479,990 | 1/1996 | Peppel . | |
| 5,551,803 | 9/1996 | Pallini, Jr. et al. | 166/355 |
| 5,641,248 | 6/1997 | Arlt, III | 405/195.1 |

FOREIGN PATENT DOCUMENTS

| | | |
|---|---|---|
| 1242769 | 8/1971 | United Kingdom . |
| 2115858 | 9/1983 | United Kingdom . |

*Primary Examiner*—Hoang C. Dang
*Attorney, Agent, or Firm*—James E. Bradley

[57] ABSTRACT

A centralizing device is provided for a riser of an offshore well platform having a frame that defines an opening through which the riser passes from the platform to a subsea wellhead. The centralizing device has a centralizing ring with an inner diameter greater than the outer diameter of the riser so that the riser can be passed longitudinally therethrough. The centralizing ring is positioned within the opening of the frame. Adjustable mounting means are used for mounting the centralizing ring to the frame at different positions within the opening. A roller assembly of the centralizing device is carried upon the riser as the riser is lowered through the centralizing ring. The roller assembly is configured to engage the centralizing ring as the riser is lowered through the centralizing ring so that the centralizing ring stops further carriage of the roller assembly by the riser. The roller assembly has rollers mounted thereon that bear against an exterior of the riser to limit lateral movement of the riser but that allow longitudinal movement of the riser when the roller assembly is engaged with the centralizing ring.

24 Claims, 3 Drawing Sheets

DRILLING RISER CENTRALIZER

BACKGROUND OF THE INVENTION

1. Field of the Invention

This invention relates to offshore drilling platforms, and in particular to devices for guiding and positioning risers of such drilling platforms.

2. Description of the Prior Art

In an offshore oil or gas well a riser is connected between the subsea wellhead and the drilling platform. Oftentimes the subsea wellhead is not in exact alignment with the drilling platform that is used to secure the riser or handle the riser during assembly. Further, the drilling platform may be subject to movement from wave action and the like, while the riser is stationarily held at the wellhead.

It is important that the portion of the riser string near the platform be in generally vertical alignment with the platform. Without this, it may be difficult to conduct drilling operations or assemble the riser or drilling strings at the surface where string sections must be aligned and coupled together. Centralizing devices are therefore used to maintain the riser in a vertical orientation at the platform. Because of movement between the wellhead and the platform, due to wave action and the like, the centralizer must allow some relative movement between the riser and the platform while maintaining the proper orientation of the riser.

Another function of the drilling riser centralizer is to keep the riser centralized when raising or lowering the risers to prevent the riser flanges from striking and damaging associated equipment.

While there are devices available to accomplish these objectives, improvements are needed.

SUMMARY OF THE INVENTION

A centralizing device is provided for a riser of an offshore well platform having a frame that defines an opening through which the riser passes to a subsea wellhead. The centralizing device has a centralizing ring with an inner diameter greater than the outer diameter of the riser so that the riser can be passed longitudinally therethrough. The centralizing ring is positioned within the opening of the frame. The centralizer has adjustable mounting means for mounting the centralizing ring to the frame at different positions within the opening.

A roller assembly of the centralizing device is carried upon the riser as the riser is lowered through the centralizing ring. The roller assembly is configured to engage the centralizing ring as the riser is lowered through the centralizing ring so that the centralizing ring stops further carriage of the roller assembly by the riser. The roller assembly has rollers mounted thereon that bear against an exterior of the riser to limit lateral movement of the riser but that allow longitudinal movement of the riser when the roller assembly is engaged with the centralizing ring.

Additional objects, features and advantages will be apparent in the written description which follows.

DETAILED DESCRIPTION OF THE INVENTION

Figure 1:
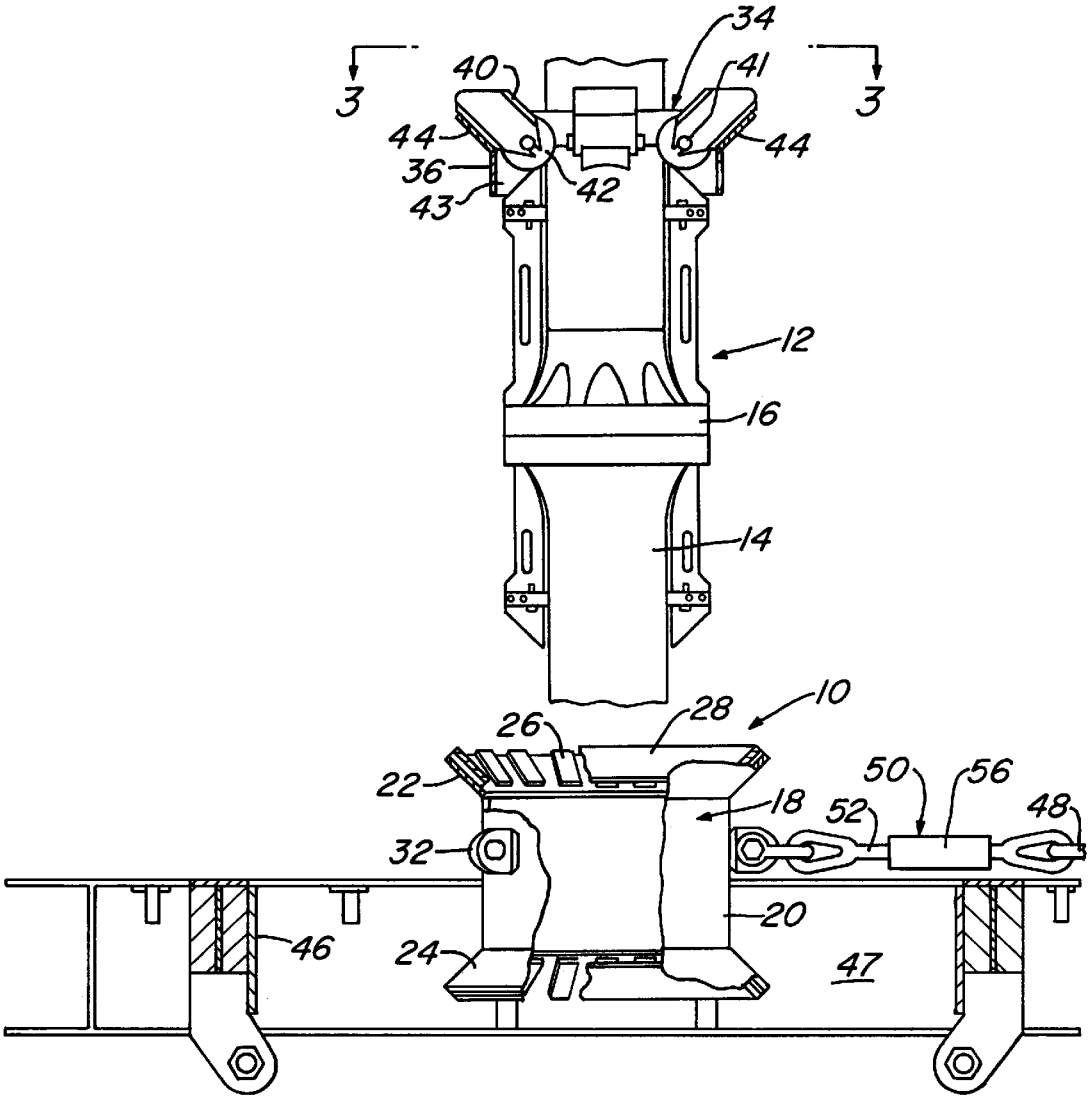
FIG. 1 is a side view of a centralizing device for a riser of an offshore well platform with the device shown partially cut away and a riser being lowered through a centralizing ring of the device and a roller assembly of the device being carried upon the riser section, the centralizing device being constructed in accordance with the invention.

Referring to the figures, FIG. 1 shows a centralizer designated generally at 10 for use with a drilling riser 12 of an offshore well platform. The riser 12 has a generally circular cross section and is formed in sections 14 that are coupled together end to end. Riser flanges 16 are provided on the ends of the riser sections 14 to facilitate coupling. As shown, the riser flanges 16 are of greater diameter than the midsections of the riser sections 14.

The centralizer 10 has a steel centralizing ring 18 that has a generally tubular or cylindrical midsection 20, which defines an aperture. The inner diameter of the midsection 20 is greater than the outer diameter of the riser 121 being passed therethrough. Joined to each end of the midsection 20 are upper and lower frusto-conical flanges 22, 24. The frusto-conical flanges 22, 24 are flared outward from the midsection 20, with the end of the flange 22, 24 having the larger diameter being spaced further from the midsection 20.

A layer of padding formed by a plurality of pads 26 that are spaced circumferentially apart is bonded to the interior surface of each flange 22, 24. Alternatively, the padding may be a single length of padding material (not shown) placed around the entire circumference of the flanges 22, 24. The pads 26 may be of any elastomeric material, such as polyurethane, or other material capable of absorbing impact against the flanges 22, 24 from the riser 12 as it is passed through the centralizing ring 18. Overlaying and secured to the interior surface of each flange 22, 24 and seated against the pads 26 is a steel flange plate 28.

Provided on the exterior of the centralizing ring 18 spaced apart about the circumference of the midsection 20 are eyelets or attachment members 32 for mounting the ring 18, as will be discussed later.

Figure 3:
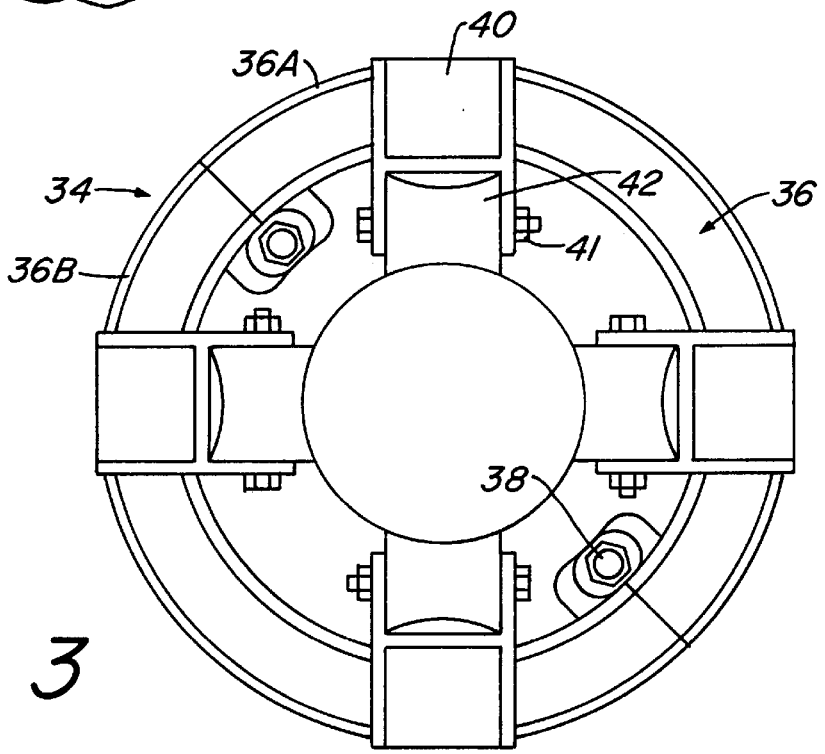
FIG. 3 is a top plan view of the device of FIG. 1, taken along the lines 3—3.

A roller assembly 34 of the centralizing device 10 has a collar 36 that fits around the riser 12. The collar 36 is formed in two halves 36A, 36B (FIG. 3) that are coupled together by means of fasteners 38. Roller arms 40 are mounted around the collar 36. In the particular embodiment shown, there are four roller arms 40 spaced approximately ninety degrees apart about the collar 36. Each of the roller arms 40 carries a bearing 41 on which is mounted a transverse roller 42. As shown in FIG. 3, the roller 42 may have a concave surface to facilitate contact with the convex exterior of the riser 12.

Figure 2:
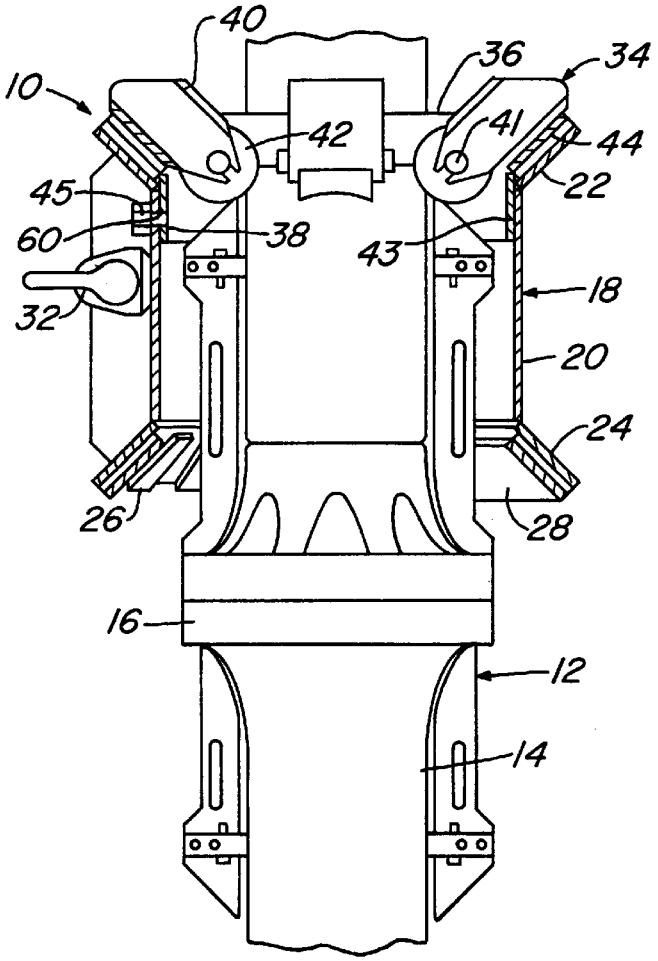
FIG. 2 is a cross-sectional side view of the centralizing device of FIG. 1 shown with the roller assembly engaged with the centralizing ring.

The collar 36 has a lower portion 43 that has a generally cylindrical exterior configuration and an upper portion 44 that is frusto-conical in shape. The frusto-conical upper portion 44 is configured so that it seats generally flush against the flange plate 28, as shown in FIG. 2. The lower cylindrical portion 43 has an outer diameter that is slightly less than the inner diameter of the midsection 20 so that the lower portion 43 can be received within the aperture formed in the midsection 20 of the centralizing ring 18.

Concentric holes 58, 60 formed in the lower portion 43 of the collar 36 and the midsection 20 of ring 18 receive a locking pin 45 for locking the roller assembly 34 to the centralizing ring 18 when the roller assembly is seated against the flange 24.

Figure 4:
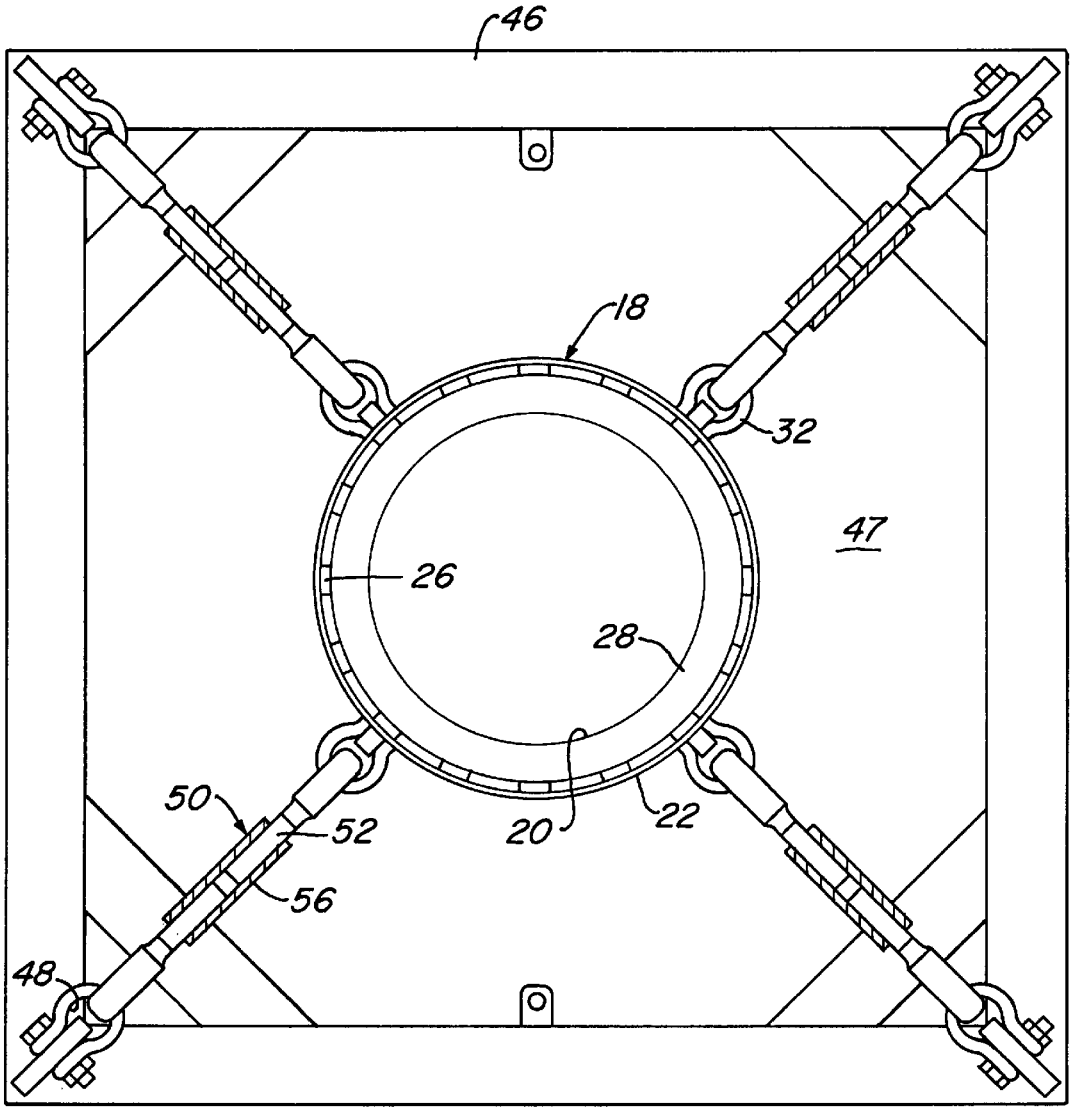
FIG. 4 is a top plan view of the device of FIG. 1 showing the centralizing ring mounted within an opening of a lower frame structure of the offshore well platform.

Referring to FIG. 4, a rectangular centralizing frame 46 of the drilling platform forms an opening 47 through which the riser 12 passes from a rotary table or spider above to the subsea wellhead below. The frame 46 has fasteners or eyes 48 located around the perimeter of the opening 47. In the embodiment shown, the eyes 48 are located in the four corners of the frame 46. The centralizing ring 18 is mounted within the opening 47 of the frame 46 by means of turnbuckles 50. The turnbuckles 50 are formed from opposite-threaded eyebolts 52 joined together by a threaded sleeve 56. One of the eyebolts 52 of each turnbuckle 50 is coupled to a fastener 48 of the frame 46, while the other is coupled to one of the eyes 32 of the centralizing ring 18. The turnbuckles 50 should be able to swivel at each end when the turnbuckles 50 are loosely adjusted so the centralizing ring may be moved from side to side. At least two turnbuckles 50 should be used. In the particular embodiment shown, there are four turnbuckles. By rotating the sleeve 56, the length of the turnbuckles 50 can be adjusted.

The operation of the centralizing device 10 is as follows. Located at a position above the frame 46 is typically a rotary table or spider (not shown) from which the riser extends and which holds the riser 12 in place at a position above the frame 46. During installation of the riser 12, the riser 12 is lowered through the aperture of the centralizing ring 18 to the subsea wellhead. Because the inner diameter of the centralizing ring 18 is greater than the outer diameter of the riser 12, a slight clearance is created that allows the riser 12 to pass easily therethrough but limits side-to-side movement of the riser. The conical flange 22 guides or funnels the riser 12 into the smaller diameter aperture of the midsection 20. This is important because the larger diameter flanges 16 of the riser 12 may have a tendency to hang or catch upon the centralizing ring 18. The conical flange 22 deflects the flanges 16 or other outwardly projecting structures of the riser 12 so that the riser is directed into the smaller midsection. The elastomeric pads 26 help absorb the impact from these portions of the riser 12 so that impact to the centralizing ring is minimized. The lower flange 24, constructed similarly, operates in the same manner as flange 22 when the riser 12 is raised through the centralizing ring 18 during retrieval. Loosening the turnbuckles 50 will also allow the centralizing ring 18 to move side to side upon impact of the flanges 22, 24 to help reduce impact load when contacted by the riser 12 as it passes through the centralizing ring.

Because the riser 12 is guided at two points, one being at the rotary table or spider and the other being the centralizing ring 18, lateral movement of the riser 12 is minimized so that the riser is maintained in a generally vertical position. If necessary, the position of the centralizing ring 18 within the opening 47 of the frame 46 can be changed to fit the center line of the riser by adjusting the lengths of the turnbuckles 50.

As the riser 12 is eventually lowered and locked onto the subsea wellhead, the roller assembly 12, which is carried upon one of the upper riser sections 14, as shown in FIG. 1, is lowered onto the centralizing ring 18. As shown in FIG. 2, the lower surface of the conical portion 43 of the collar 36 of the roller assembly 34 engages and seats against the flange plate 28 of the conical flange 22 so that further carriage of the roller assembly 35 is stopped. Once the roller assembly 34 is landed onto the centralizing ring 18 as described, the roller assembly 34 is locked in placed onto the centralizing ring. This is accomplished by inserting the locking pin 45 into the concentric holes 58, 60.

With the roller assembly 34 locked in place, the rollers 42 bear against the exterior of the riser 12 to limit any lateral movement of the riser 12 within the centralizing ring 18 while allowing longitudinal movement of the riser 18. This is important because a drilling platform may have a tendency to move up and down relative to the riser, which is stationarily anchored at the subsea wellhead. The roller assembly 34 thus allows relative movement of the riser and platform while preventing lateral or side-to-side movement of the riser 12 within the centralizing ring so that the riser is centralized after it is coupled to the subsea wellhead.

The centralizing device of the invention has several advantages. The device is simple in design and easily used. The outwardly flared flanges of the centralizing ring help guide the riser through the smaller midsection so that the riser does not catch or hang during running or retrieval of the riser. The padding on the flanges also help reduce impact load on the riser and allow the riser to be passed through the ring at a greater velocity. The turnbuckles provide an easy means for adjusting the positioning of the centralizing ring and by loosening the turnbuckles, the centralizing ring can be moved side to side upon impact to also help reduce impact load.

The roller assembly provides centralization of the riser after the riser is landed and locked onto the subsea wellhead. The cooperating relationship of the roller assembly and centralizing ring make the roller assembly easy to install and lock in place. The roller assembly is merely secured around and carried upon one of the riser sections and lowered with the riser until it lands upon the centralizing ring.

While the invention has been shown in only one of its forms, it is not thus limited but is susceptible to various changes and modifications without departing from the spirit thereof.

We claim:

1. A centralizing device for a riser of an offshore well platform, the platform having a frame that defines an opening through which the riser passes to a subsea wellhead located below the platform, the device comprising:

a centralizing ring having an inner diameter greater than the outer diameter of the riser so that the riser can be passed longitudinally therethrough, the centralizing ring being positioned within the opening of the frame;

adjustable mounting means for mounting the centralizing ring to the frame at different positions within the opening; and a roller assembly that is carried upon the riser as the riser is lowered through the centralizing ring, the roller assembly being configured to engage the centralizing ring as the riser is lowered through the centralizing ring so that further carriage of the roller assembly by the riser is stopped, the roller assembly having rollers mounted thereon that bear against an exterior of the riser to limit lateral movement of the riser within the centralizing ring but that allow longitudinal movement of the riser when the roller assembly is engaged with the centralizing ring.

2. The device of claim 1, wherein:

roller assembly is a collar formed in two halves that are secured together about the riser.

3. The device of claim 1, wherein:

the centralizing ring has an outwardly flared flange on at least one of the upper and lower ends.

4. The device of claim 3, wherein:

the outwardly flared flange is frusto-conical in configuration.

5. The device of claim 1, wherein:

the adjustable mounting means includes at least two turnbuckles having opposite ends, one end of each turnbuckle being secured to the centralizing ring and the other end of each turnbuckle being secured to the frame so that the centralizing ring is mounted to the frame and can be moved to different positions within the opening of the frame by adjusting the length of the turnbuckles.

6. The device of claim 1, wherein:

the roller assembly has locking means for locking the roller assembly to the centralizing ring when in engagement therewith.

7. The device of claim 6, wherein:

the locking means includes a locking pin that is received in locking pin holes formed in the centralizing ring and roller assembly.

8. The device of claim 3, wherein:

the outwardly flared flange has elastomeric pads mounted thereon to absorb impact from the riser as the riser is passed through the centralizing ring.

9. The device of claim 1, wherein:

there are two outwardly flared flanges, one at each of the upper and lower ends of the centralizing ring.

10. A centralizing device for a riser of an offshore well platform, the platform having a frame that defines an opening through which the riser passes to a subsea wellhead, the device comprising:

a centralizing ring having an inner diameter greater than the outer diameter of the riser so that the riser can be passed longitudinally therethrough, the centralizing ring being positioned within the opening of the frame, the centralizing ring having an outwardly flared flange at the upper end;

at least two turnbuckles having opposite ends, one end of each turnbuckle being secured to the centralizing ring and the other end of each turnbuckle for securing to the frame so that the centralizing ring can be mounted to the frame and can be moved to different positions within the opening of the frame by adjusting the length of the turnbuckles; and a roller assembly formed from a collar having rollers mounted thereon that is configured to be carried upon the riser as the riser is lowered through the centralizing ring, the roller assembly seating against the outwardly flared flange as the riser is lowered through the centralizing ring so that further carriage of the roller assembly by the riser is stopped, the rollers of the roller assembly bearing against an exterior of the riser to limit lateral movement of the riser within the centralizing ring but that allows longitudinal movement of the riser when the roller assembly is seated against the outwardly flared flange.

11. The device of claim 10, wherein:

the collar of the roller assembly is formed in two halves that are secured together about the riser.

12. The device of claim 10, wherein:

the outwardly flared flange is frusto-conical in configuration.

13. The device of claim 10, wherein:

the roller assembly has locking means for locking the roller assembly to the centralizing ring when the roller assembly is seated against the outwardly flared flange.

14. The device of claim 13, wherein:

the locking means includes a locking pin that is received in locking pin holes formed in the centralizing ring and roller assembly.

15. The device of claim 10, wherein:

the outwardly flared flange has elastomeric pads mounted thereon to absorb impact from the riser as the riser is passed through the centralizing ring.

16. The device of claim 10, wherein:

there are two outwardly flared flanges, one at each of the upper and lower ends of the centralizing ring.

17. A method for centralizing and guiding a riser of an offshore well platform, the platform having a frame that defines an opening through which the riser passes to a subsea wellhead, the method comprising:

providing a centralizing ring having an inner diameter greater than the outer diameter of the riser;

providing adjustable mounting means for mounting the centralizing ring to the frame at different positions within the opening of the frame;

positioning the centralizing ring within the opening of the frame at a desired position utilizing the adjustable mounting means;

providing a roller assembly having rollers for bearing against an exterior of the riser;

positioning the roller assembly about the riser so that the roller assembly is carried thereon; and then lowering the riser through the centralizing ring while the roller assembly is carried on the riser and allowing the roller assembly to engage the centralizing ring so that further carriage of the roller assembly by the riser is stopped, and wherein the rollers of the roller assembly bear against the exterior of the riser to limit lateral movement while allowing longitudinal movement of the riser when the roller assembly is engaged with the centralizing ring.

18. The method of claim 17, wherein:

the roller assembly is a collar formed in two halves; and wherein the roller assembly is positioned about the riser by securing together the collar halves about the riser.

19. The method of claim 17, wherein:

the centralizing ring is provided with an outwardly flared flange on at least one of the upper and lower ends.

20. The method of claim 19, wherein:

the outwardly flared flange is frusto-conical in configuration.

21. The method of claim 17, wherein:

the adjustable mounting means includes at least two turnbuckles having opposite ends, one end of each turnbuckle being secured to the centralizing ring and the other end of each turnbuckle being secured to the frame; and wherein positioning the centralizing ring includes adjusting the length of the turnbuckles so that the centralizing ring is moved to the desired position.

22. The method of claim 17, wherein:

the roller assembly has locking means for locking the roller assembly to the centralizing ring when in engagement therewith.

23. The method of claim 19, wherein:

the outwardly flared flange has elastomeric pads mounted thereon to absorb impact from the riser as the riser is passed through the centralizing ring.

24. The device of claim 17, wherein:

there are two outwardly flared flanges, one at each of the upper and lower ends of the centralizing ring.

* * * * *